US009455084B2

(12) United States Patent
Peck, Jr.

(10) Patent No.: US 9,455,084 B2
(45) Date of Patent: Sep. 27, 2016

(54) VARIABLE CORE ELECTROMAGNETIC DEVICE

(71) Applicant: THE BOEING COMPANY, Chicago, IL (US)

(72) Inventor: James Leo Peck, Jr., Huntington Beach, CA (US)

(73) Assignee: The Boeing Company, Chicago, IL (US)

( * ) Notice: Subject to any disclaimer, the term of this patent is extended or adjusted under 35 U.S.C. 154(b) by 56 days.

(21) Appl. No.: 14/228,799

(22) Filed: Mar. 28, 2014

(65) Prior Publication Data

US 2014/0210585 A1 Jul. 31, 2014

Related U.S. Application Data

(63) Continuation-in-part of application No. 13/553,267, filed on Jul. 19, 2012, now Pat. No. 9,159,487.

(51) Int. Cl.
*H01F 27/24* (2006.01)
*H01F 30/06* (2006.01)
(Continued)

(52) U.S. Cl.
CPC ..... *H01F 30/06* (2013.01); *H01F 17/00* (2013.01); *H01F 17/06* (2013.01); *H01F 27/24* (2013.01); *H01F 27/306* (2013.01)

(58) Field of Classification Search
CPC ..... H01F 27/00–27/30; H01F 17/00–17/06
USPC ..... 336/83, 174–175, 220–223, 233–234
See application file for complete search history.

(56) References Cited

U.S. PATENT DOCUMENTS 352,105 A 11/1886 Zipebnowsky
2,411,374 A 11/1943 Horstman
(Continued)

FOREIGN PATENT DOCUMENTS

DE 2926423 A1 1/1981
DE 4129265 A1 3/1993
(Continued)

OTHER PUBLICATIONS

Fedder, Gary K., et al.; "Laminated High-Aspect-Ratio Microstructures in a Conventional CMOS Process," Proceedings of the IEEE Micr Proceedings of the IEEE Micro Electro Mechanical Systems Workshop, 1996, pp. 13-18.
(Continued)

*Primary Examiner* — Tuyen Nguyen
(74) *Attorney, Agent, or Firm* — Charles L. Moore; Moore & Van Allen PLLC

(57) ABSTRACT

An electromagnetic device includes a variable magnetic flux core having a plurality of core sections stacked on one another. At least one core section of the plurality of core sections may include a different selected geometry and/or a different chosen material. The at least one core section is configured to provide a predetermined inductance performance. An opening is provided through the stacked plurality of core sections for receiving a conductor winding. An electrical current flowing through the conductor winding generates a magnetic field about the conductor winding and a magnetic flux flow in each of the plurality of core sections. The magnetic flux flow in the at least one core section is different from the other core sections in response to the different selected geometry and/or the different chosen material of the at least one core section to provide the predetermined inductance performance.

8 Claims, 12 Drawing Sheets

(51) Int. Cl.

| | |
|---|---|
| ***H01F 17/00*** | (2006.01) |
| ***H01F 17/06*** | (2006.01) |
| ***H01F 27/30*** | (2006.01) |

(56) References Cited

U.S. PATENT DOCUMENTS

| | | | | |
|---|---|---|---|---|
| 2,569,675 | A * | 10/1951 | Keefe | H01F 29/10 336/119 |
| 3,042,849 | A | 7/1962 | Dortort | |
| 3,411,121 | A * | 11/1968 | Twomey | H01F 27/263 336/210 |
| 3,464,002 | A | 8/1969 | Hentschel | |
| 4,020,440 | A | 4/1977 | Moerman | |
| 4,338,657 | A | 7/1982 | Lisin | |
| 4,520,335 | A * | 5/1985 | Rauch | H01F 27/245 336/212 |
| 4,565,746 | A * | 1/1986 | Hayase | H01F 27/245 336/234 |
| 4,668,931 | A * | 5/1987 | Boenitz | H01F 27/245 336/212 |
| 4,684,882 | A | 8/1987 | Blain | |
| 4,897,626 | A | 1/1990 | Fitter | |
| 5,351,017 | A | 9/1994 | Yano | |
| 5,486,756 | A | 1/1996 | Kawakami et al. | |
| 5,534,831 | A | 7/1996 | Yabuki | |
| 5,534,837 | A | 7/1996 | Brandt | |
| 5,668,707 | A | 9/1997 | Barrett | |
| 6,144,282 | A * | 11/2000 | Lee | H01F 27/245 336/217 |
| 6,181,079 | B1 | 1/2001 | Chang et al. | |
| 6,715,198 | B2 | 4/2004 | Kawakami | |
| 7,106,047 | B2 | 9/2006 | Taniguchi | |
| 7,148,675 | B2 * | 12/2006 | Itoh | G01R 15/202 324/117 H |
| 7,342,477 | B2 | 3/2008 | Brandt | |
| 7,362,206 | B1 | 4/2008 | Herbert | |
| 7,378,828 | B2 | 5/2008 | Brandt | |
| 7,639,520 | B1 | 12/2009 | Zansky et al. | |
| 8,980,053 | B2 | 3/2015 | Krahn et al. | |
| 9,106,125 | B1 | 8/2015 | Brandt et al. | |
| 9,159,487 | B2 | 10/2015 | Peck | |
| 2002/0163330 | A1 | 11/2002 | Sekiya | |
| 2003/0117251 | A1 | 6/2003 | Haugs et al. | |
| 2004/0027121 | A1 | 2/2004 | Choi et al. | |
| 2004/0051617 | A1 | 3/2004 | Buswell | |
| 2004/0124958 | A1 | 7/2004 | Watts et al. | |
| 2004/0135661 | A1 * | 7/2004 | Haugs | G05F 1/32 336/212 |
| 2006/0082430 | A1 | 4/2006 | Sutardja | |
| 2006/0197480 | A1 | 9/2006 | Mori et al. | |
| 2008/0150664 | A1 | 6/2008 | Blankenship et al. | |
| 2008/0163475 | A1 | 7/2008 | Snyder | |
| 2009/0244937 | A1 | 10/2009 | Liu | |
| 2010/0134058 | A1 | 6/2010 | Nagashima et al. | |
| 2010/0164673 | A1 * | 7/2010 | Shim | H01F 27/365 336/221 |
| 2010/0194373 | A1 | 8/2010 | Hamberger et al. | |
| 2011/0095858 | A1 | 4/2011 | Spurny | |
| 2011/0163834 | A1 * | 7/2011 | Stahmann | H01F 3/02 336/221 |
| 2011/0210722 | A1 | 9/2011 | Paci et al. | |
| 2012/0150679 | A1 | 6/2012 | Lazaris | |
| 2012/0226386 | A1 | 9/2012 | Kulathu et al. | |
| 2013/0043725 | A1 | 2/2013 | Birkelund | |
| 2013/0049751 | A1 | 2/2013 | Hamberger | |
| 2014/0022040 | A1 | 1/2014 | Peck | |
| 2014/0210585 | A1 | 7/2014 | Peck, Jr. | |
| 2014/0232384 | A1 | 8/2014 | Peck, Jr. | |
| 2015/0043119 | A1 | 2/2015 | Peck, Jr. | |

FOREIGN PATENT DOCUMENTS

| | | | |
|---|---|---|---|
| EP | 1345036 | A2 | 9/2003 |
| EP | 2688076 | A2 | 1/2014 |
| JP | 01242333 | A | 9/1989 |
| JP | 0977452 | A1 | 3/1997 |
| WO | 2007078403 | A2 | 7/2007 |
| WO | 2014130122 | A1 | 8/2014 |

OTHER PUBLICATIONS

Chee, Clinton Y.K., et al.; "A Review on the Modelling of Piezoelectric Sensors and Actuators Incorporated in Intelligent Structures," Journal of Intelligent Material Journal of Intelligent Material Systems and Structures, 1998, pp. 3-19, vol. 9.

Wilson, Earl J.; "Strain-Gage Instrumentation," Harris' Shock an Harris' Shock and Vibration Handbook, 2002, pp. 17.1-17.15, Chapter 17, 5th Edition.

Simoes Moita, Jose M., et al.; "Active control of adaptive laminated structures with bonded piezoelectric sensors and actuators," Computers and Structures, 2004, PA Computers and Structures, 2004, pp. 1349-1358, vol. 82.

European Patent Office; International Search Report and Written Opinion for International Application No. PCT/US2013/072789 dated May 27, 2014, 12 Pages.

International Bureau of WIPO; International Preliminary Report on Patentability for International Application No. PCT/US2013/072789 dated Aug. 25, 2015, 9 Pages.

European Patent Office; Extended European Search Report for European Patent Application No. 14179801.7 dated Jul. 10, 2015, 14 Pages.

European Patent Office; European Patent Application No. 14176702.8, European Search Report dated Jan. 21, 2015, 7 pages.

* cited by examiner

VARIABLE CORE ELECTROMAGNETIC DEVICE

CROSS-REFERENCE TO RELATED APPLICATIONS

This application is a continuation-in-part of U.S. patent applicant Ser. No. 13/553,267, filed Jul. 19, 2012, entitled "Linear Electromagnetic Device" which is assigned to the same assignee as the present application and is incorporated herein in its entirety by reference.

FIELD

The present disclosure relates to electromagnetic devices, such as electrical transformers and inductors, and more particularly to a electromagnetic device, such as a transformer, inductor or similar device including a variable magnetic flux core.

BACKGROUND

Electromagnetic devices, such as inductors, transformers and similar devices include magnetic cores in which a magnetic flux flow may be generated in response to an electrical current flowing through a conductor winding associated with the magnetic core. As current (AC) in the magnetic core increases, the inductance in the core increases (energy storage in the device increases). In a transformer configuration which includes a primary winding connected to an electrical power source and a secondary winding connected to a load, changes in the current or voltage supplied by the electrical power source can significantly change the energy being stored in the magnetic core for transfer into the secondary. FIG. 1 is an example of an electromagnetic device 100 which may be an inductor or transformer. The electromagnetic device 100 includes a plurality of electrical conductors, wires or windings 102 wrapped or wound around a ferromagnetic core 104. The core 104 is an electromagnetic material and is magnetized in response to an electrical current flowing in the windings 102. A magnetic flux illustrated by broken lines 106 and 108 is also generated by the electromagnetic device 100 in response to the electrical current flowing through the windings 102. As illustrated in FIG. 1, the magnetic flux 106 and 108 will flow in a path through the core 102 and in the free space about the electromagnetic device 100. Accordingly, the magnetic flux 106 and 108 flowing in free space about the electromagnetic device 100 does not produce any useful energy coupling or transfer and is inefficient. Because of this inefficiency, such prior art electromagnetic devices, inductors, transformers and the like, generally require larger, heavier electromagnetic cores and additional windings to provide a desired energy conversion or transfer. Additionally, core may be formed by stacking a plurality of plates that define a substantially square or rectangular shaped box. The flux throughout the core will be uniform because of the uniform shape of the core.

SUMMARY

In accordance with an embodiment, an electromagnetic device includes a variable magnetic flux core. The variable magnetic flux core may include a plurality of core sections stacked on one another. At least one core section of the plurality of core sections may include at least one of a different selected geometry and a different chosen material from the other core sections. The at least one core section is configured to provide a predetermined inductance performance in response to or based on the at least one of the different selected geometry and the different chosen material. An opening is provided through the stacked plurality of core sections of the variable magnetic flux core for receiving a conductor winding extending through the opening and the variable magnetic flux core. An electrical current flowing through the conductor winding generates a magnetic field about the conductor winding and a magnetic flux flow in each of the plurality of core sections of the variable magnetic flux core. The magnetic flux flow in the at least one core section is different from other core sections in response to or based on the at least one of the different selected geometry and the different chosen material of the at least one core section to provide the predetermined inductance performance.

In accordance with another embodiment, an electromagnetic device includes a variable magnetic flux core. The variable magnetic flux core may include a plurality of core sections stacked on one another. At least one core section of the plurality of core sections may include at least one of a different selected geometry and a different chosen material from the other core sections. The at least one core section is configured to provide a predetermined inductance performance in response to or based on the at least one of the different selected geometry and the different chosen material. The electromagnetic device also includes a first elongated opening through the stacked plurality of core sections of the variable magnetic flux core for receiving at least one conductor winding extending through the first elongated opening and the variable magnetic flux core. The electromagnetic device may also include a second elongated opening parallel to the first elongated opening through the stacked plurality of core sections for receiving the at least one conductor winding extending through the second elongated opening and the variable magnetic flux core. An electrical current flowing through the conductor winding generates a magnetic field about the conductor winding and a magnetic flux flow in each of the plurality of core sections of the variable magnetic flux core. The magnetic flux flow in the at least one core section may be different from the other core sections in response to or based on the at least one of the different selected geometry and the different chosen material of the at least one core section to provide the predetermined inductance performance.

In accordance with further embodiment, a method for providing a predetermined inductance performance by an electromagnetic device may include providing a variable magnetic flux core by stacking a plurality of core sections on one another. At least one of the core sections of the plurality of core sections may include at least one of a different selected geometry and a different chosen material from the other core sections. The at least one core section is configured to provide a predetermined inductance performance in response to or based on the at least one of the different selected geometry and the different chosen material. The method may also include providing an elongated opening through the stacked plurality of core sections of the variable magnetic flux core for receiving a conductor winding extending through the elongated opening and the variable magnetic flux core. An electrical current flowing through the conductor winding generates a magnetic field about the conductor winding and a magnetic flux flow in each of the plurality of core sections of the variable magnetic flux core. The magnetic flux flow in the at least one core section may be different from the other core sections in response to or based on the at least one of the different selected geometry and the different chosen material of the particular core section to provide the predetermined inductance performance.

BRIEF DESCRIPTION OF THE SEVERAL VIEWS OF DRAWINGS

The following detailed description of embodiments refers to the accompanying drawings, which illustrate specific embodiments of the disclosure. Other embodiments having different structures and operations do not depart from the scope of the present disclosure.

DESCRIPTION

Figure 1:
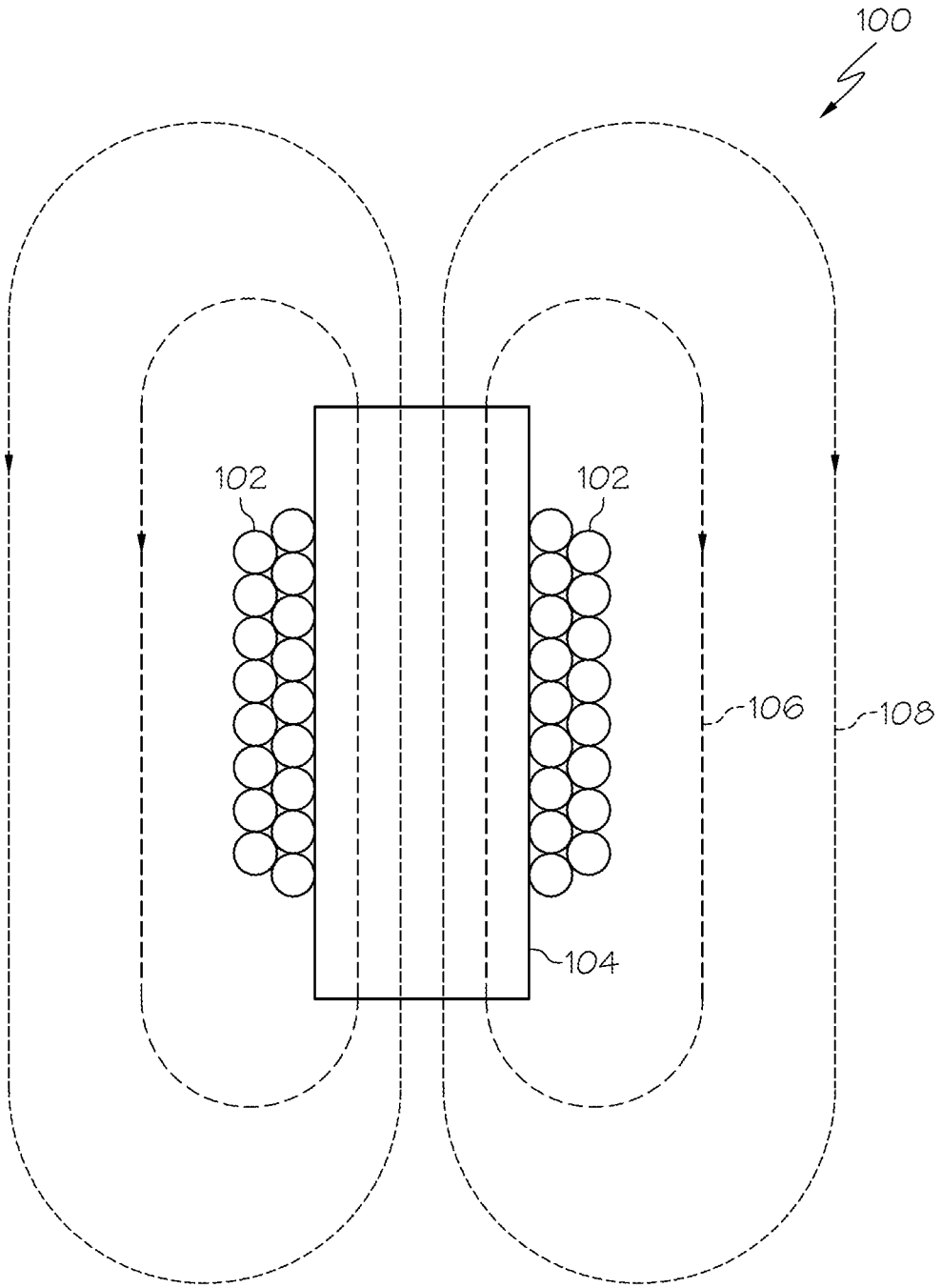
FIG. 1 (PRIOR ART)
FIG. 1 is an example of a prior art transformer.

The following detailed description of embodiments refers to the accompanying drawings, which illustrate specific embodiments of the disclosure. Other embodiments having different structures and operations do not depart from the scope of the present disclosure. Like reference numerals may refer to the same element or component in the different drawings.

In accordance with an embodiment of the present disclosure, a linear inductor is an electromagnetic device having only one electrical conductor wire winding or windings passing through a magnetic core. In accordance with another embodiment, a linear transformer is an electromagnetic device where a linear primary electrical conductor wire winding or windings and one or more linear secondary electrical conductor wire winding or windings pass through a magnetic core. The core may be one piece and no turns of the primary and secondary electrical conductors about the core are required. While the core may be one piece, the one piece core may be formed from a plurality of stacked plates or laminates. A current may be conducted through the primary. A magnetic flux from the current in the primary is absorbed by the core. When the current in the primary decreases the core transmits an electromotive force (desorbs) into the secondary wires. A feature of the linear transformer is the linear pass of the primary and secondary conductors through the core. One core may be used as a standalone device or a series of two or more cores may be used where a longer linear exposure is required. Another feature of this transformer is that the entire magnetic field or at least a substantial portion of the magnetic field generated by the current in the primary is absorbed by the core, and desorbed into the secondary. The core of the transformer may be sized or include dimensions so that substantially the entire magnetic field generated by the current is absorbed by the core and so that the magnetic flux is substantially completely contained with the core. This forms a highly efficient transformer with very low copper losses, high efficiency energy transfer, low thermal emission and very low radiated emissions. Additionally the linear transformer is a minimum of about 50% lower in volume and weight then existing configurations. Linear electromagnetic devices, such as linear transformers, inductors and similar devices are described in more detail in U.S. patent application Ser. No. 13/553,267, filed Jul. 19, 2012, entitled "Linear Electromagnetic Device" which is incorporated herein in its entirety by reference. A magnetic core flux sensor assembly is described in more detail in U.S. patent application Ser. No. 13/773,135, filed Feb. 21, 2013, entitled "Magnetic Core Flux Sensor and is incorporated herein in its entirety by reference.

Figure 2A:
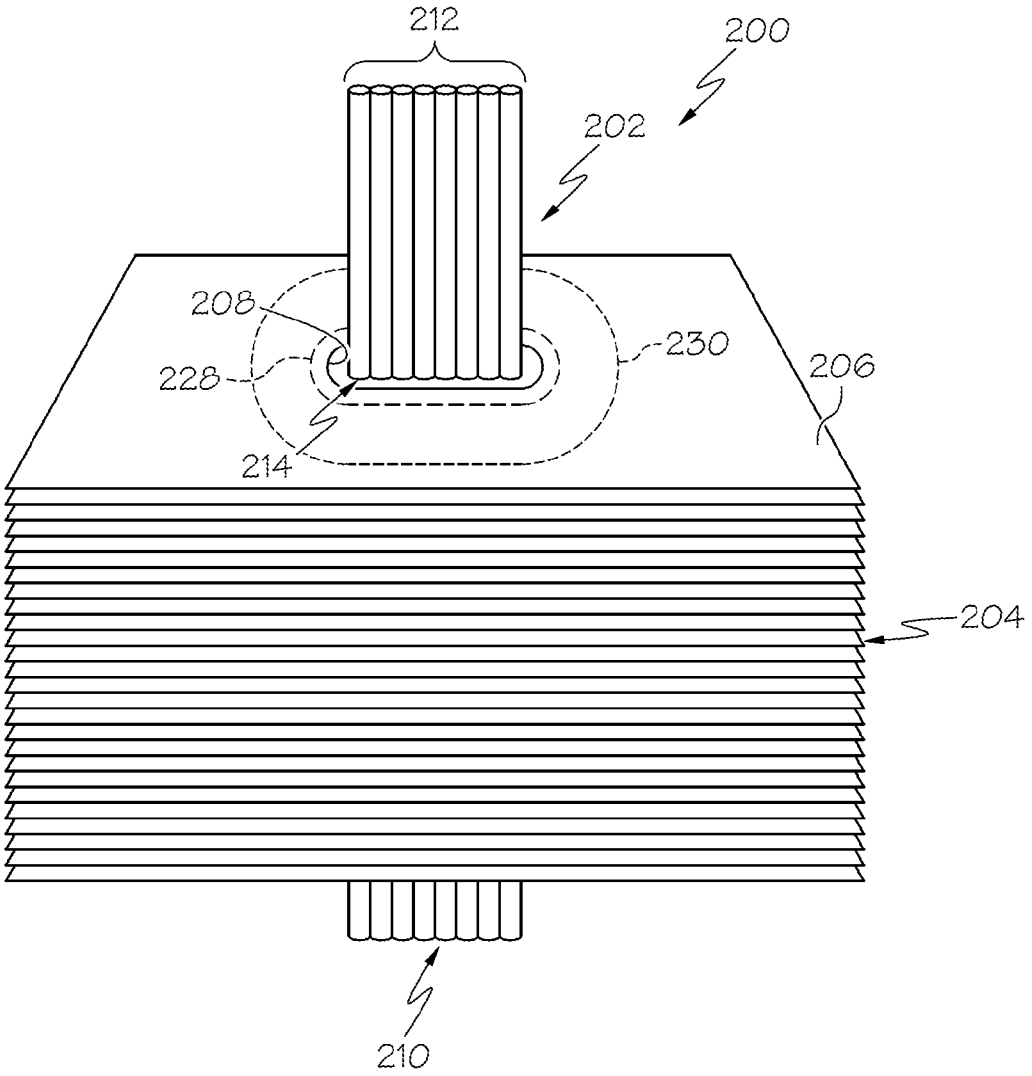
FIG. 2A is a perspective view of an example of an electromagnetic device in accordance with an embodiment of the present disclosure.

FIG. 2A is a perspective view of an example of an electromagnetic device 200 in accordance with an embodiment of the present disclosure. The electromagnetic device 200 illustrated in FIG. 2A is configured as a linear inductor 202. The linear inductor 202 may include a core 204. The core 204 may include a plurality of plates 206 or laminations stacked on one another. The plates 206 may be made from a silicon steel alloy, a nickel-iron alloy or other metallic material capable of generating a magnetic flux similar to that described herein. For example, the core 204 may be a nickel-iron alloy including about 20% by weight iron and about 80% by weight nickel. The plates 206 may be substantially square or rectangular, or may have some other geometric shape depending on the application of the electromagnetic device and the environment where the electromagnetic device 200 may be located. For example, the substantially square or rectangular plates 206 may be defined as any type of polygon to fit a certain application or may have rounded corners so that the plates 206 are not exactly square or rectangular.

An opening is formed through each of the plates 206 and the openings are aligned to form an opening 208 or passage through the core 204 when the plates 206 are stacked on one another with the plate openings 206 in alignment with one another. The opening 208 or passage may be formed in substantially a center or central portion of the core 204 and extend substantially perpendicular to a plane defined by each plate 206 of the stack of plates 206 or laminates. In another embodiment, the opening 208 may be formed off center from a central portion of the core 204 in the planes defined by each of the plates 206 for purposes of providing a particular magnetic flux or to satisfy certain constraints.

An electrical conductor 210 or wire may be received in the opening 208 and may extend through the core 204 perpendicular the plane of each of the plates 206. The electrical conductor 210 may be a primary conductor. In the exemplary embodiment illustrated in FIG. 2A, the electrical conductor 210 is a plurality of electrical conductors 212 or wires. In another embodiment, the electrical conductor 210 may be a single conductor.

Figure 2B:
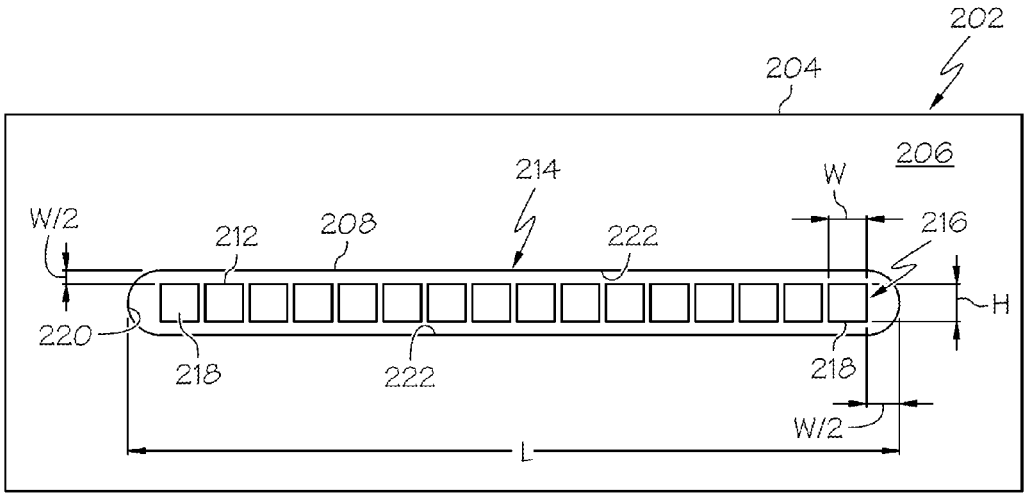
FIG. 2B is a top view of the electromagnetic device of FIG. 2A.

Referring also to FIG. 2B, FIG. 2B is a top view of the linear inductor 202 of FIG. 2A. The opening 208 through the core 204 may be an elongated slot 214. As previously discussed, the opening 208 or elongated slot 214 may be formed through a center or central portion of the core 204 when looking into the plane of the top plate 206. The opening 208 or elongated slot 214 may be an equal distance from opposite sides of the core 204, or as illustrated in FIG. 2B, the elongated slot 214 may be off set and may be closer to one side of the core 204. For some applications, the opening 208 may also be formed in a shape other than an elongated slot 214 depending upon the application and desired path of the magnetic flux generated in the core.

As previously discussed, the electrical conductor 210 may be a plurality of primary conductors 212 that are aligned adjacent one another or disposed in a single row 216 within the elongated slot 214. Each of the conductors 212 may include a substantially square or rectangular cross-section as illustrated in FIG. 2B. The substantially square or rectangular cross-section may be defined as being exactly square or rectangular or may have rounded edges or other features depending upon the application and desired coupling or transfer of magnetic flux into the core 204 when an electrical current flows through the conductors 212. The conductor 210 may also be a single elongated ribbon conductor extending within the elongated slot 214 and having a cross-section corresponding to the elongated slot 214 or other opening shape.

The cross-section of each primary conductor 212 may have a predetermined width "W" in a direction corresponding to an elongated dimension or length "L" of the elongated slot 214. An end primary conductor 218 at each end of the single row 216 of conductors is less than about one half of the predetermined width "W" from an end 220 of the elongated slot 214. Each conductor 212 also has a predetermined height "H." Each conductor 212 is less than about one half of the predetermined height "H" from a side wall 222 of the elongated slot 214.

Figure 2C:
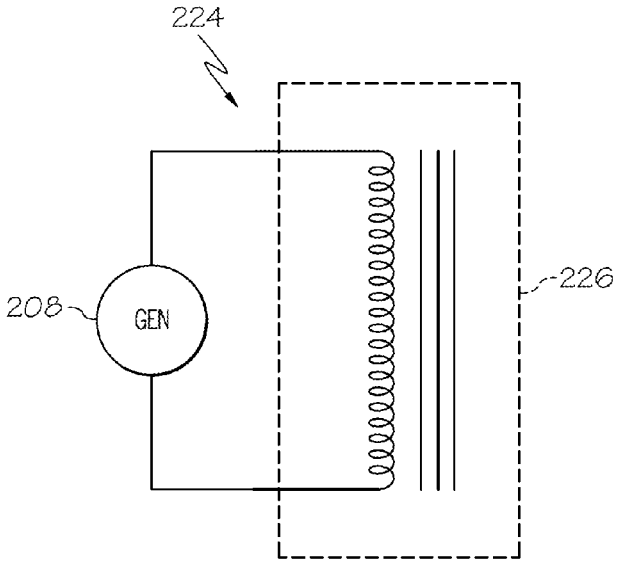
FIG. 2C is a block diagram an example of an electrical circuit including the linear inductor of FIG. 2A in accordance with an embodiment of the present disclosure.

FIG. 2C is a block diagram an example of an electrical circuit 224 including a linear inductor 226 in accordance with an embodiment of the present disclosure. The linear inductor 226 may be the same as the linear inductor 202 in FIGS. 2A and 2B. A generator 208 may be connected to the linear inductor 226 to conduct an electrical current through the linear inductor 226. A magnetic field is generated about the electrical conductor 210 (FIGS. 2A and 2B) or each of the plurality of electrical conductors 212 in response to the electrical current flowing in the conductor or conductors. The core 204 may be sized so that substantially the entire magnetic field is absorbed by the core 204 to generate a magnetic flux in the core 204 as illustrated by broken lines 228 and 230 in FIG. 2A and the core may be sized so that the magnetic flux is substantially completely contained within the core. In an embodiment, the core 204 may be sized relative to the conductor or conductors 212 and electrical current flowing in the conductor or conductors 212 to absorb at least about 96% of the magnetic field to generate the magnetic flux in the core 204. The magnetic flux may also be at least about 96% contained within the core 24. Any magnetic flux generated outside the core 204 may be infinitesimally small compared to the magnetic flux contained within the core.

Figure 3A:
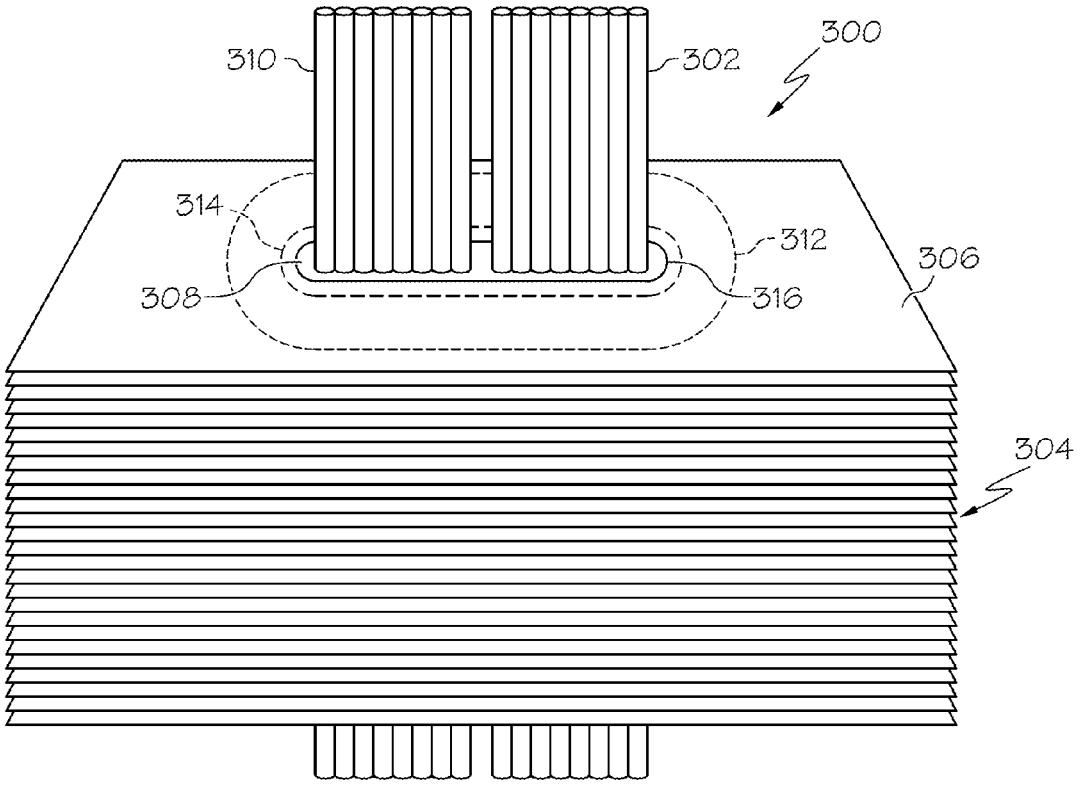
FIG. 3A is a perspective view of an example of an electromagnetic device configured as a linear transformer in accordance with an embodiment of the present disclosure.

FIG. 3A is a perspective view of an example of an electromagnetic device in the configuration of a linear transformer 300 in accordance with an embodiment of the present disclosure. The linear transformer 300 is similar to the linear inductor 202 of FIG. 2A but includes a secondary conductor 302 or plurality of secondary conductors. Accordingly, the linear transformer 300 includes a core 304 in which a magnetic flux may be generated. Similar to that previously described, the core 304 may include a plurality of plates or laminations 306 that may be stacked upon one another as illustrated and FIG. 3A. Each of the plates 306 may have an opening formed therein to provide an opening 308 or passage through the core 304. The opening 308 or passage through the core 304 may be substantially perpendicular to a plane defined by each of the plates 306. The secondary conductor or conductors 302 extend within the opening 308 through the core 304. The primary conductor or plurality of primary conductors 310 may extend adjacent to the secondary conductors 302 within the opening 308 through the core 304.

Similar to that previously described, each of the primary conductors 310 may have a substantially square or rectangular cross-section. An electrical current flowing through the primary conductor or conductors generates a magnetic field about the primary conductor. The core 304 may be sized or to include length and width dimensions of the plates 306 to absorb substantially the entire magnetic field to generate the magnetic flux as illustrated by broken lines 312 and 314 in FIG. 3A. The core 304 may also be sized or include length and width dimensions so that the magnetic flux is substantially entirely contained within the core 304. In an embodiment, the core 304 may be sized or may include width and length dimensions of the plates 306 to absorb at least about 96% of the magnetic field and/or to contain at least about 96% of the magnetic flux.

Each of the secondary conductors 302 extending through the core 304 may also have a substantially square or rectangular cross-section to receive an electro-motive force transmitted by the core 304.

The opening 308 through the core 304 may be an elongated slot 316 similar to the elongated slot 214 in FIGS. 2A and 2B. The plurality of primary conductors 310 and plurality of secondary conductors 302 may each be disposed adjacent one another in a single row in the elongated slot 316.

A cross-section of each primary conductor 310 of the plurality of conductors and each secondary conductor 302 of the plurality of conductors may have a predetermined width "W" in a direction corresponding to a length of the elongated slot 316 similar to that illustrated in FIG. 2B. An end primary conductor adjacent one end of the elongated slot 316 is less than about one half of the predetermined width "W" from the one end of the elongated slot 316. An end secondary conductor adjacent an opposite end of the elongated slot 316 is less than about one half of the predetermined width "W" from the opposite end of the elongated slot.

The cross-section of each primary conductor 310 and secondary conductor 302 may have a predetermined height "H." Each primary conductor 310 and second conductor 302 is less than about one half of the predetermined height "H" from a side wall of the elongated slot 316.

Figure 3B:
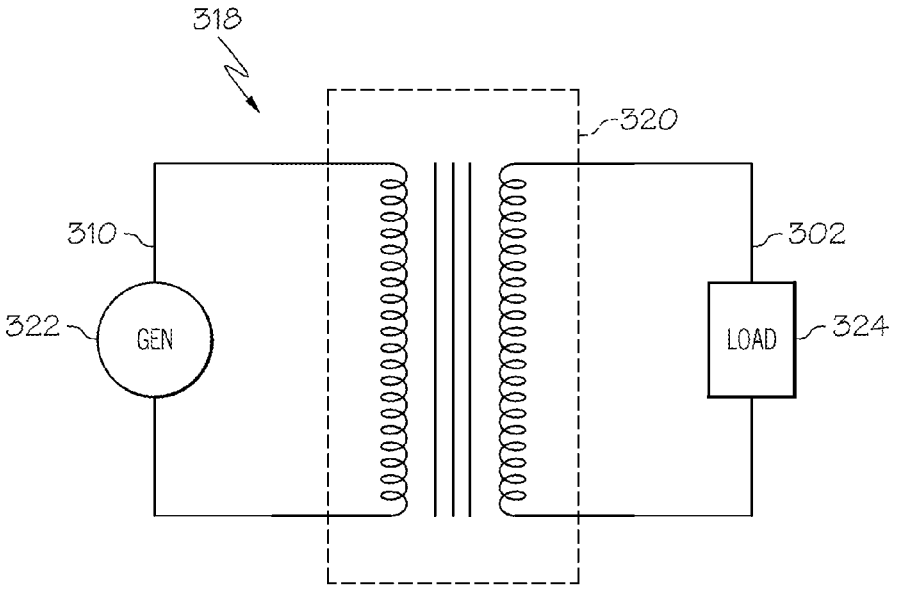
FIG. 3B is a block diagram an example of an electrical circuit including the linear transformer of FIG. 3A in accordance with an embodiment of the present disclosure.

FIG. 3B is a block diagram an example of an electrical circuit 318 including a linear transformer 320 in accordance with an embodiment of the present disclosure. The linear transformer 320 may be the same as the linear transformer 300 in FIG. 3A. A generator 322 may be connected to the primary conductors 310 and a load 324 may be connected to the secondary conductors 302. Voltage and current supplied by the generator 322 to the linear transformer 320 is converted or transformed based on the number and characteristics of primary conductors or windings and the number and characteristics of secondary conductors or windings and the core 304.

Figure 4A:
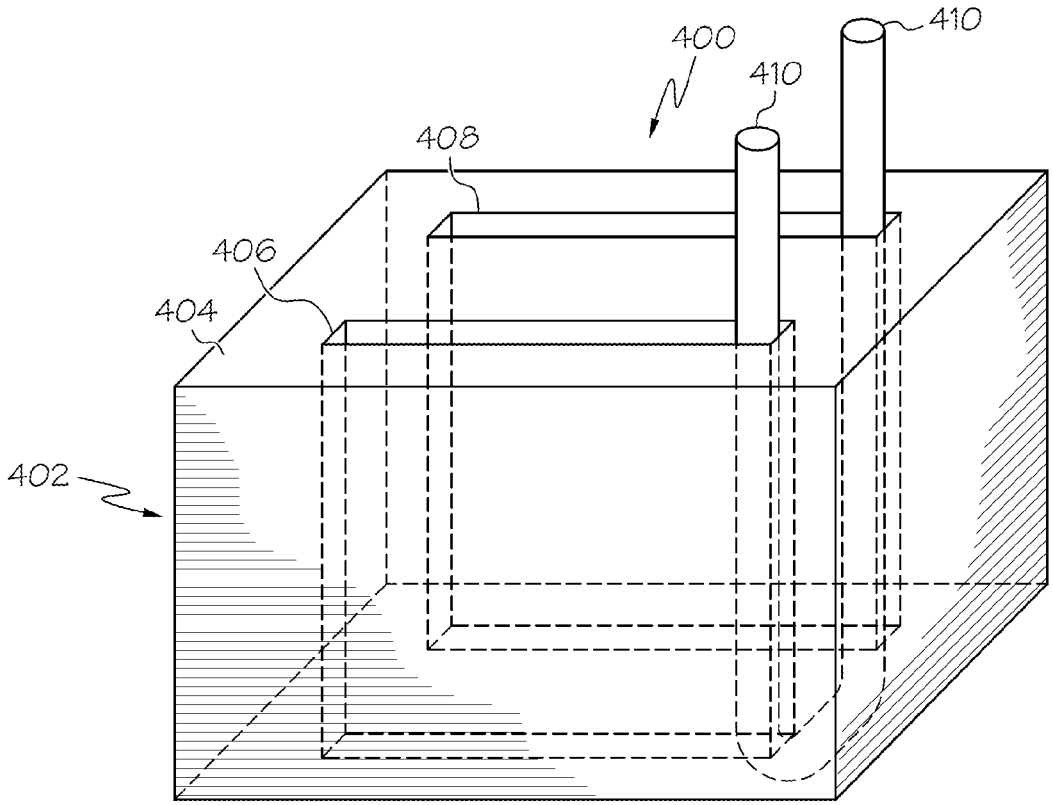
FIG. 4A is a perspective view of an example of an electromagnetic device in accordance with another embodiment of the present disclosure.
Figure 4B:
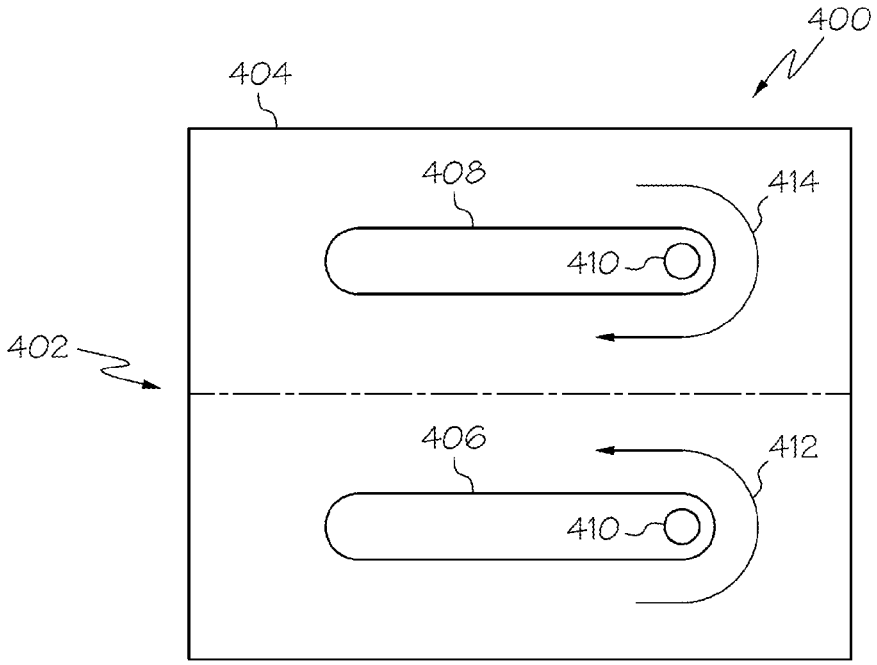
FIG. 4B is a top view of an example of a plate or laminate that may be used in the electromagnetic device of FIG. 4A.

FIG. 4A is a perspective view of an example of an electromagnetic device 400 in accordance with another embodiment of the present disclosure. The electromagnetic device 400 may be similar to the electromagnetic device 200 in FIG. 2A or the electromagnetic device 300 in FIG. 3A. The electromagnetic device 400 may include a magnetic flux core 402. The magnetic flux core 402 may be formed by a plurality of plates 404 or laminates stacked or layered on one another as illustrated in FIG. 4A. Referring also to FIG. 4B, FIG. 4B is a top view of an example of a plate 404 or laminate that may be used for the plate 404 in FIG. 4A. Each of the plates 404 or laminates may be substantially square or rectangular shaped. The plates 404 being substantially square or rectangular shaped may be defined as the plates 404 not being exactly square or rectangular shaped. For example, the plates 404 may have rounded edges, the sides may not be perfectly square, the sides may have different lengths, opposite sides may not be exactly parallel or some other differences.

Each of the plates 404 may include a first elongated opening 406 or slot and a second elongated opening 408 or slot. The first elongated opening 406 and the second elongated opening 408 in each of the plates 404 are aligned with one another when the plates 404 are stacked on one another to form the core 402. At least one conductor winding 410 may be received in the first elongated opening 406 and the second elongated opening 408. Only a single conductor or wire wrap is illustrated in FIGS. 4A and 4B to represent the at least one conductor winding 410 for purposes of clarity. The at least one conductor winding 410 may include a single wire wrapped or wound multiple times through the elongated openings 406 and 408. For example, in an inductor configuration, the electromagnetic device 400 may include a single conductor winding, similar to the single conductor winding 212 illustrated in FIG. 2A, extending through the first elongated opening 406 and the second elongated opening 408 in the magnetic flux core 402. The winding 410 or windings may extend substantially completely across the openings 406 and 408.

In a transformer configuration, the electromagnetic device 400 may include a primary conductor winding and a secondary conductor winding similar to primary conductor winding 310 and secondary conductor winding 302 illustrated in FIG. 3A. The primary conductor winding and the secondary conductor winding may be side-by-side or adjacent one another in the first elongated opening 406 and second elongated opening 408 similar to that illustrated in FIG. 3A.

An electrical current flowing through the conductor winding 410 in FIG. 4B generates a magnetic field around the primary conductor winding 410 and a magnetic flux flow is created in the magnetic core 402 as illustrated by arrows 412 and 414 in FIG. 4B. The magnetic flux flow in the magnetic core 402 will be in opposite directions about the respective elongated openings 406 and 408, as illustrated by arrows 412 and 414, because of the direction of electric current flow in the electrical conductor winding 410 through the elongated openings 406 and 408 and the right-hand rule. Based on the right-hand rule, electric current flowing into the page on FIG. 4B in windings 410 through elongated opening 408 will cause a magnetic flux flow in the direction of arrow 414 in the example in FIG. 4B, and electric current flowing out of the page in the same windings 410 through elongated opening 406 will cause a magnetic flux flow in the direction of arrow 412. If the current flows in the opposite direction in the winding 410, the direction of the magnetic flux flow will be opposite to that shown in the example of FIG. 4B.

Figure 5A:
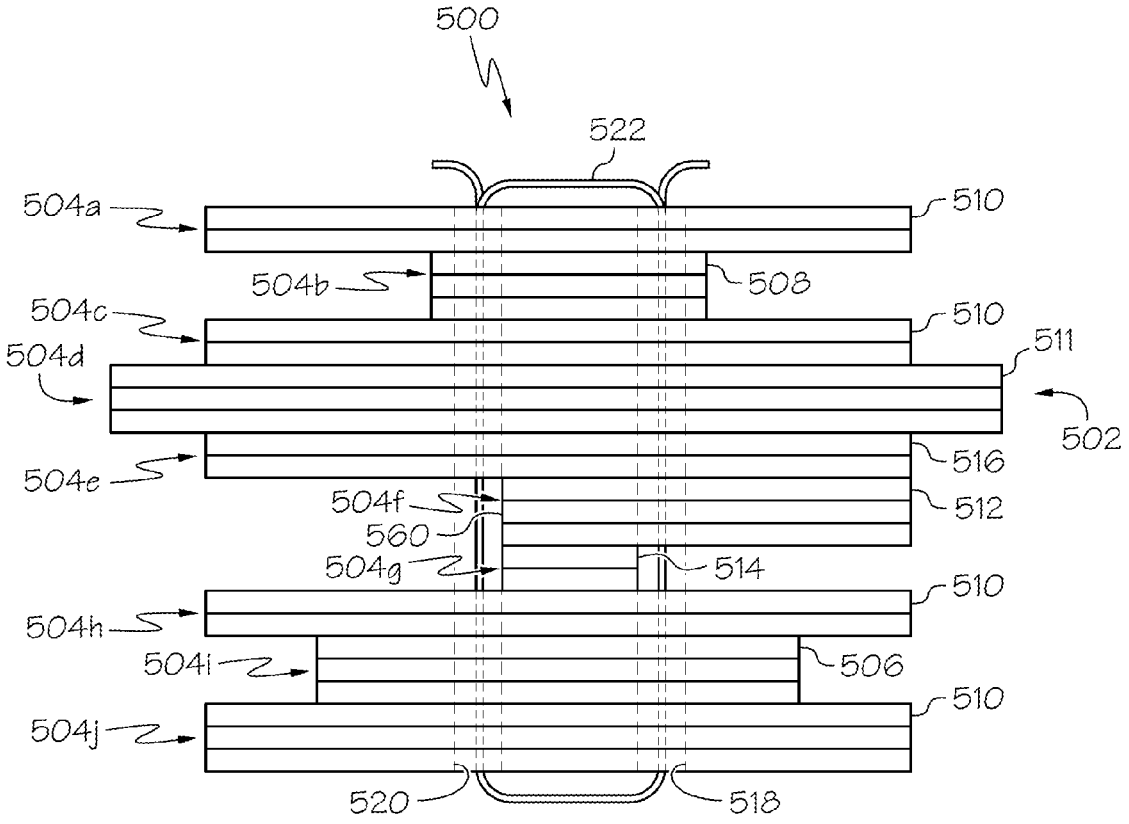
FIG. 5A is a side view of an example of an electromagnetic device including a variable magnetic flux core in accordance with a further embodiment of the present disclosure.

FIG. 5A is a side view of an example of an electromagnetic device 500 including a variable magnetic flux core 502 in accordance with a further embodiment of the present disclosure. The electromagnetic device 500 may be similar to the electromagnetic device 400 of FIG. 4A except the electromagnetic device 500 includes the variable magnetic flux core 502. The variable magnetic flux core 502 may include a plurality of core sections 504*a*-504*j*. Each of the plurality of core sections 504*a*-504*j* may include at least one of a different selected geometry and a different chosen material configured to provide a predetermined inductance performance in response to or based on the at least one of the different selected geometry and the different chosen material. Each of the core sections 504*a*-504*j* may include one or more plates 506-516 or laminates stacked on one another as illustrated in FIG. 5A. Each plate 506-516 of a particular core section 504*a*-504*j* may include a substantially identical geometry. Examples of the different plates 506-516 with different geometries that may be used in the different core sections 504*a*-505*i* will be described in more detail with reference to FIGS. 5B-5G. Each plate 506-516 of a particular section 504*a*-504*j* may have a substantially identical geometry in that the geometry of each plate in a particular section 504*a*-504*j* may not be exactly identical.

The electromagnetic device 500 may include at least one opening through the stacked plurality of core sections 504*a*-504*j*. The embodiment of the electromagnetic device 500 illustrated in FIG. 5A includes a first elongated opening 518 and a second elongated opening 520 through the stacked plurality of core sections 504*a*-504*j* of the variable magnetic flux core 502. The first and second elongated openings 518 and 520 may be similar to the elongated openings 406 and 408 of the electromagnetic device 400 in FIGS. 4A and 4B. The elongated openings 518 and 520 are best shown in the different plates 506-516 in FIGS. 5B-5G including different examples of plate geometries that may be stacked in the different core sections 504*a*-504*j*. An example of an electromagnetic device 600 with a single elongated opening will be described with reference to FIGS. 6A-6D.

The first elongated opening 518 and the second elongated opening 520 may be configured for receiving at least one conductor winding 522 extending through the first and second elongated openings 518 and 520 and the variable magnetic flux core 502. An electrical current flowing through the conductor winding 522 generates a magnetic field about the conductor winding 522 and a magnetic flux flow in each of the plurality of core sections 504*a*-405*i* of the variable magnetic flux core 502 similar to that described with reference to FIG. 4B above. The magnetic flux flow in a particular core section 504*a*-504*j* will be different from other core sections in response to at least one of the different selected geometry and the different chosen material of the particular core section 504*a*-504*j* to provide the predetermined inductance profile of each core section 504*a*-504*j* and predetermined inductance performance or profile of the electromagnetic device 500.

Referring also to FIGS. 5B-5G, FIGS. 5B-5G are each a top view of an example of different type of plate 506-516 or laminate that may be used to form the variable magnetic flux core 502 of the electromagnetic device 500 of FIG. 5A. The exemplary plates 506-516 in FIGS. 5B-5G are not intended to be exhaustive and other plate geometries or configurations may also be used to provide a particular desired performance by each of the core segments and the variable magnetic flux core overall. As previously discussed, each plate of a particular core section 504*a*-504*j* will have a substantially identical geometry. The exemplary plates 506-516 are shown in FIGS. 5B-5G as including a plane surface that is square or rectangular shaped. However, other geometries may also be used depending upon a particular magnetic flux flow desired in a particular plate and a desired resulting performance of a core section in which the particular plate geometry may be used. Additionally, the exemplary plates 506-516 may have rounded corners or the plates 506-516 may have rounded ends corresponding to the ends of the elongated openings 518 and 520. In some embodiments, the sides of the plates 506-516 may not necessarily meet at right angles and the opposite sides of the plates 506-516 may not necessarily be parallel or the same length. Accordingly, the plates 505-516 may include a surface 524 that may be substantially square or rectangular shaped.

Figure 5B:
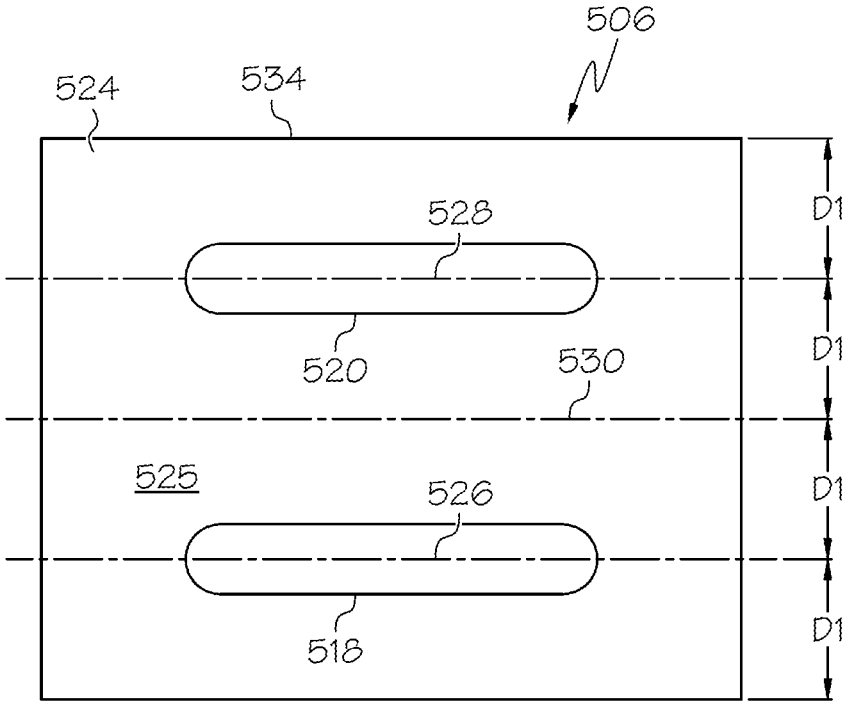
FIGS. 5B-5G are each a top view of an example of a different type of plate or laminate that may be used to form the variable magnetic flux core of the electromagnetic device of FIG. 5A.

FIG. 5B is an example of a first core plate 506 that may be stacked with one or more other first core plates 506 to form a first core section of a variable magnetic flux core, such as for example core section 504*i* of magnetic flux core 502 in FIG. 5A. The substantially identical geometry of each first core plate 506 may include a surface 524 that is substantially square or rectangular shape having a first predetermined area 525. A centerline (represented by chain lines 526 and 528 in FIGS. 5B-5G) of each of the first elongated opening 518 and the second elongated opening 520 may be parallel to a centerline 530 of the surface 524 of the first core plate 506. The centerline 526 and 528 of each elongated opening 518 and 520 may be a first distance "D1" from the centerline 530 of the surface 524 of the first core plate 506. Accordingly, the elongated openings 518 and 520 of first core plates 506 will be aligned when stacked to form a first core section and when the core sections are stacked to form the variable magnetic flux core 502 and the centerline 526 and 528 of each elongated opening 518 and 520 may be the same distance or the first distance "D1" from each of the sides 532 and 534 of the first core plate 506 that are parallel to the elongated openings 518 and 520.

Figure 5C:
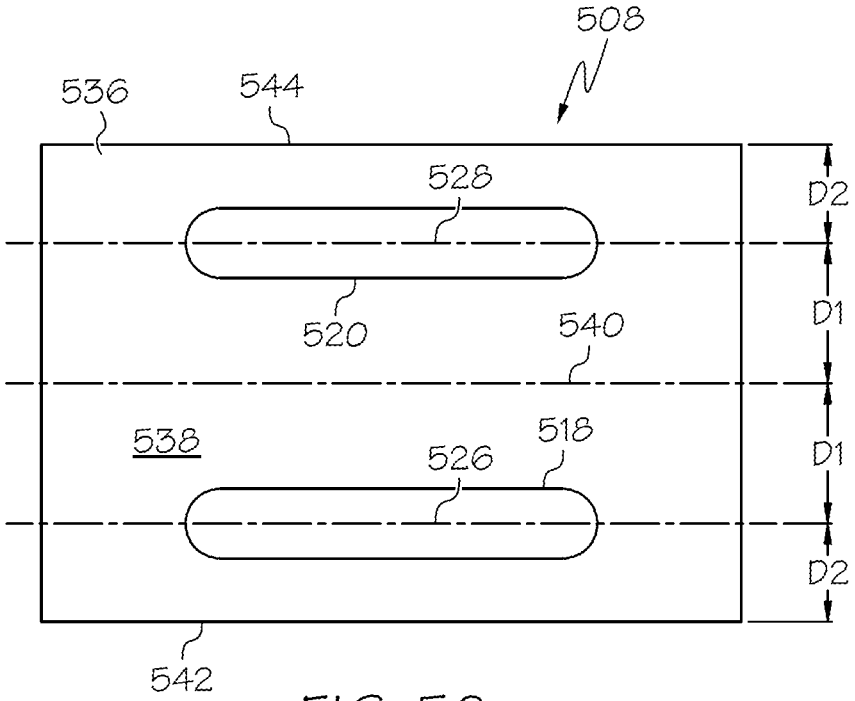

FIG. 5C is an example of a second core plate 508 that may be stacked with one or more other second core plates 508 to form a second core section or second core type section of a variable magnetic flux core, such as for example core section 504*b* of the magnetic flux core 502 in FIG. 5A. The substantially identical geometry of each second core plate 508 may include a surface 536 including a substantially square or rectangular shape having a second predetermined area 538 that is smaller than the first predetermined area 525 of the first core plate 506. The centerline 526 and 528 of each of the first elongated opening 526 and the second elongated opening 528 may be parallel to a centerline 540 of the surface 536 of the second core plate 508. The centerline 526 and 528 of each elongated opening 518 and 520 may be the first distance "D1" from the centerline 540 of the surface 536 of the second core plate 508. Accordingly, the elongated openings 518 and 520 of second core plates 508 will be aligned when stacked to form a second core section and when the different core sections are stacked to form the variable magnetic flux core 502. The centerline 526 and 528 of each elongated opening 518 and 520 may be a second distance "D2" from each side 542 and 544 of the second core plate 508 that is parallel to the elongated openings 518 and 520. The second distance "D2" is less than the first distance "D1."

Figure 5D:
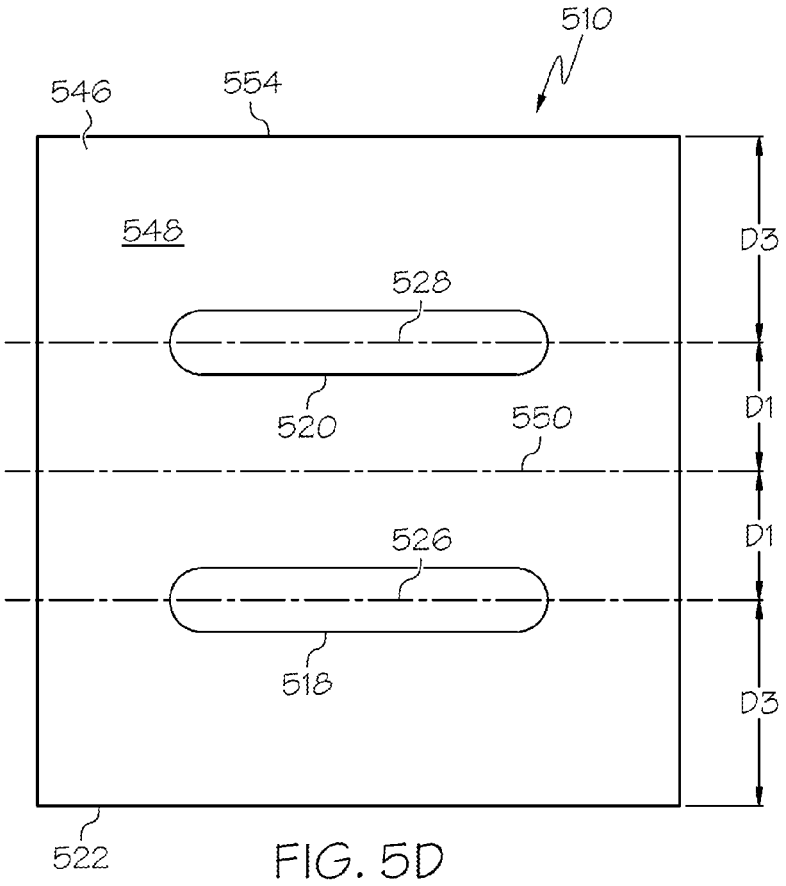

FIG. 5D is an example of a third core plate 510 that may be stacked with one or more other third core plates 510 to from a third core section of a variable magnetic flux core. Examples a third core section may be core sections 504*a*, 504*c*, 504*h* and 504*j* in FIG. 5A. Core section 504*d* has a similar geometry to the third core plate 510 but has a longer length and therefore larger area than the plates in core sections 504*a*, 504*c*, 504*h* and 504*j* as described below. The substantially identical geometry of each third core plate 510 of a third core section may include a surface 546 including a substantially square or rectangular shape having a third predetermined area 548 larger than the first predetermined area 525 of the first core plate 506. The centerline 526 and 528 of each of the first elongated opening 518 and the second elongated opening 520 are parallel to a centerline 550 of the surface 546 of the third core plate 510. The centerline 526 and 528 of each elongated opening 518 and 520 is the first distance "D1" from the centerline 550 of the surface 546 of the third core plate 510 and the centerlines 526 and 528 of each elongated opening 518 and 520 is a third distance "D3" from each side 552 and 554 of the third core plate 510 that is substantially parallel to the elongated openings 518 and 520. The third distance "D3" is greater than the first distance "D1."

The distance "D3" may be any distance greater than the first distance "D1" and the distance "D3" may be different or vary to form different core sections with different inductance performance characteristics, such as core sections 504*c* and 504*d* in FIG. 5A. Core section 504*d* has a core plate 511 (FIG. 5A) similar to the core plate 510 in FIG. 3D of core section 504*c* (FIG. 5A). However the distance "D3" of core plate 511 in the core section 504*d* will be greater than the distance "D3" of the core plates in core section 504*c* as shown in FIG. 5A.

Figure 5E:
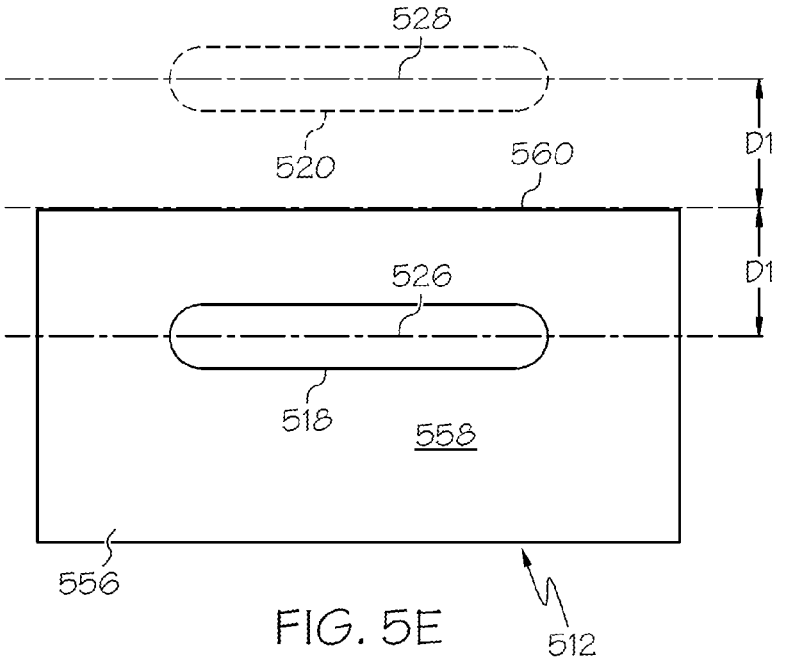

FIG. 5E is an example of a fourth core plate 512 that may be stacked with one or more other fourth core plates 512 to from a fourth core section of a variable magnetic flux core. An example a fourth core section may be core section 504*f* in FIG. 5A. The substantially identical geometry of each fourth core plate 512 of a fourth core section 504*f* may include a surface 556 including a substantially square or rectangular shape having a fourth predetermined area 558 smaller than the first predetermined area 525 of the first core plate 506. The fourth core plate 512 may include only one of the first and second elongated openings 518 and 520. In the exemplary fourth core plate 512 in FIG. 5E only the first elongated opening 518 is shown. The second elongated opening 520 may be directly adjacent a side 560 of the fourth core plate 512 as shown in FIG. 5A, or in another embodiment, the centerline 528 of the other elongated opening or second elongated opening 520 may be at a chosen distance, for example "D1," from the side 560 of the fourth core plate 512 as illustrated by the phantom line in FIG. 5E.

Figure 5F:
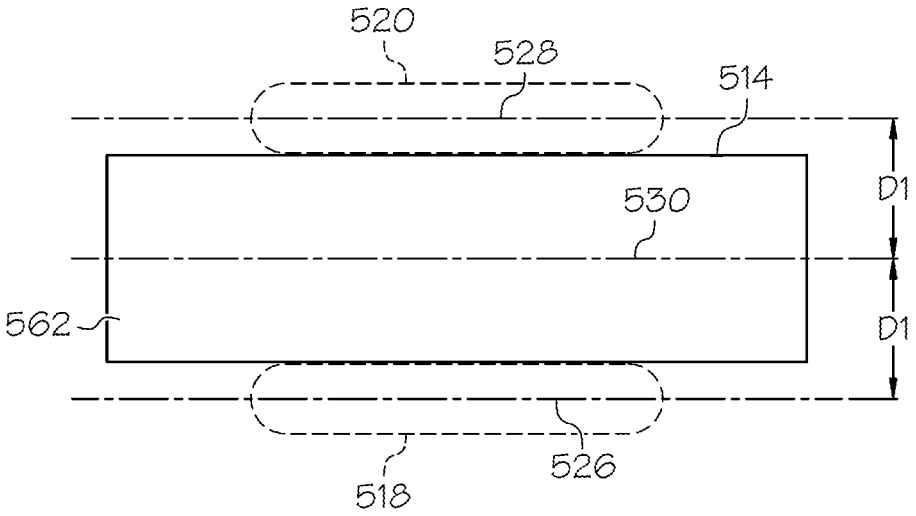

FIG. 5F is an example of a fifth core plate 514 that may be stacked with one or more other fifth core plates 514 to form a fifth core section of the variable magnetic flux core. An example of a fifth core section may be core section 504*g* in FIG. 5A. The substantially identical geometry of each fifth core plate 514 of a fifth core section may include a surface 562 including a substantially square or rectangular shape. The fifth core plate 514 is disposed between the first elongated opening 518 and the second elongated opening 520 (represented by dashed lines in FIG. 5F) through other core sections when the fifth core section (core section 504*g* in FIG. 5A for example) is stacked with the other core sections to form a variable magnetic flux core 502.

Figure 5G:
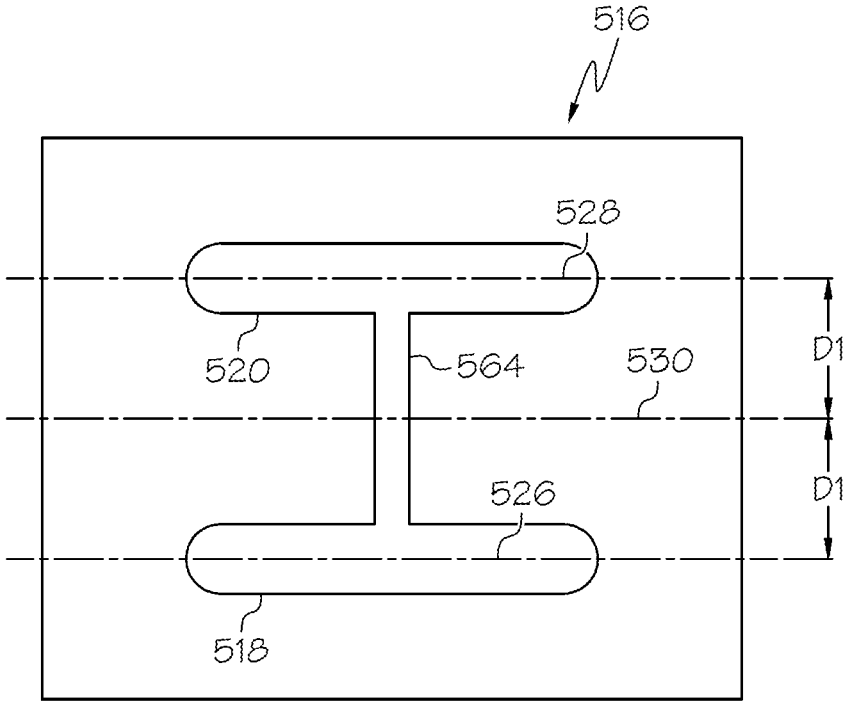

FIG. 5G is an example of a sixth core plate 516. The sixth core plate 516 includes a gap 564 between the first elongated opening 518 and the second elongated opening 520. Any of the other core plates described above may include a gap between the elongated openings 518 and 520. The gap 564 in FIG. 5G is shown extending substantially perpendicular between the elongated openings 518 and 520 proximate a midpoint of each elongated opening 518 and 520. However, in other embodiments, the gap 564 may extend between the elongated openings 518 and 520 at any location along the elongated openings 518 and 520 and may even extend diagonally or at an angle other than perpendicular between the elongated openings 518 and 520. The gap 564 will cause a disruption of the magnetic flux flow in a core section formed by stacking one or more sixth core plates 516 and the resulting inductive performance of the core section will be different from other core sections without a gap.

In another embodiment, a gap, similar to gap 564, may also be extended from the elongated opening 518 of the fifth core plate 512 in FIG. 5E to the side 560 of the fifth core plate 512 to provide a predetermined inductive performance by a core section formed by stacking one or more fifth core plates 512 with a gap.

As previously discussed, different core sections may be formed by stacking one or more of each of the different geometry core plates 506-516 in FIGS. 5B-5G and the different core sections may be stacked in a predetermined configuration to form a variable magnetic flux core, such as variable magnetic flux core 502, that provides a predetermined inductance performance. For example, core sections 504*a*-504*j* in FIG. 5A formed by core plates 506-516 with more material or core volume surrounding the elongated openings 518 and 520 will absorb more of the magnetic field generated in response to an electrical current flowing through the conductor winding 522 and will have a larger magnetic flux flow based on the amplitude of the magnetic field than a core section formed with core plates 506-516 with less material or core volume. A core section with a smaller core volume may lose some of the magnetic field depending on the strength or magnitude of the magnetic field. A stronger or higher magnitude magnetic field may extend outside of the core section and not be completely absorbed by the core section for generating the magnetic flux flow in the core section. Accordingly, the magnetic flux flow will be lower in core sections with less core volume and the core section and the inductance performance characteristics will be less than core section with a larger core volume.

Accordingly, core sections formed by stacking third core plates 510 (FIG. 5D) will absorb more of a magnetic field than the other core plate geometries shown in FIGS. 5B-5G and will have a higher inductance performance or profile.

Core sections formed by stacking the first core plates 506 (FIG. 5B) will not be as capable of absorbing as much of a magnetic field as core sections formed by the larger volume third core plates 510 but will have a higher inductance performance or profile than the other core plate geometries formed using core plates such as core plates 508 (FIG. 5*c*), 512 (FIG. 5E) and 514 (FIG. 5F).

Core sections formed by stacking the second core plates 508 (FIG. 5C) will have a lower inductance performance or profile than core sections with the first core plates 506 but will have better inductance performance or inductance profile than core sections formed by using the fourth core plates 512 (FIG. 5E) and fifth core plates 514 (FIG. 5F).

Core sections formed by stacking the fifth core plates 514 will absorb the least amount of the magnetic field and will generate the least magnetic flux flow. Hence core sections formed by stacking the fifth core plates 514 will have the lowest inductance performance and lowest inductance profile compared to core sections formed by the other core plate geometries illustrated in FIGS. 5B-5G.

As previously discussed, core sections may also be formed from different chosen materials configured to provide a predetermined inductance performance or inductance profile. The core plates 506-516 stacked to form the different core sections 504*a*-504*j* may be formed from the different chosen materials. For example, the plates 506-516 may be made from a silicon steel alloy, a nickel-iron alloy or other metallic material capable of generating a magnetic flux similar to that described herein. For example a core section may be a nickel-iron alloy including about 20% by weight iron and about 80% by weight nickel. These percentages may be changed or configured to provide different inductance profiles and performance.

Figure 6A:
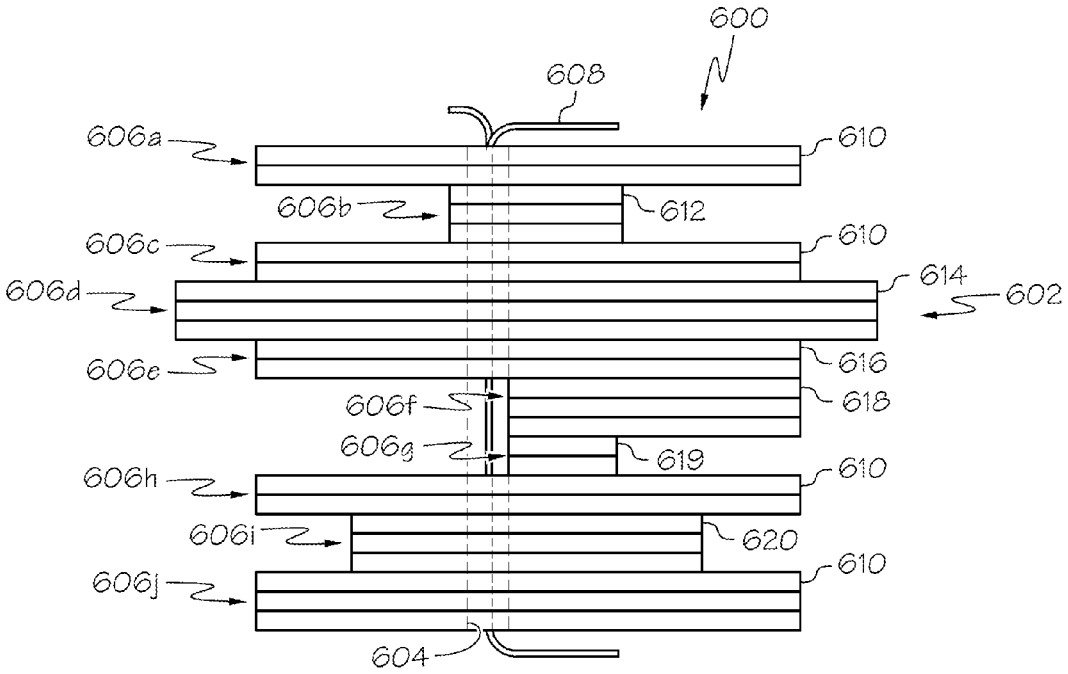
FIG. 6A is a side view of an example of an electromagnetic device including a variable magnetic flux core in accordance with another embodiment of the present disclosure.

FIG. 6A is a side view of an example of an electromagnetic device 600 including a variable magnetic flux core 602 in accordance with another embodiment of the present disclosure. The electromagnetic device 600 may be similar to the electromagnetic device 500 of FIG. 5A except the electromagnetic device 600 may include a single opening 604 for receiving an electrical conductor winding 608. The variable magnetic flux core 602 may include a plurality of core sections 606*a*-606*j* stacked on one another. Each of the plurality of core sections 606*a*-606*j* may include at least one of a different selected geometry and a different chosen material configured to provide a predetermined inductance performance in response to the at least one of the different selected geometry and the different chosen material.

The single opening 604 is formed through the stacked plurality of core sections 606*a*-606*j* of the variable magnetic flux core 602 for receiving the electrical conductor winding 608 extending through the opening 604 and the variable magnetic flux core 602. An electrical current flowing through the conductor winding 608 generates a magnetic field about the conductor winding 608 and a magnetic flux flow, similar to that described with respect to FIG. 4B, in each of the plurality of core sections 606*a*-606*j*. The magnetic flux flow in a particular core section 606*a*-606*j* is different from the magnetic flux flow in other core sections 606*a*-606*j* in response to the at least one of the different selected geometry and the different chosen material of the particular core section to provide the predetermined inductance performance.

The opening 604 through the stacked plurality of core sections 606*a*-606*j* may be an elongated slot similar to the elongated slot 214 through the magnetic flux core 204 in FIG. 2A.

Figure 6B:
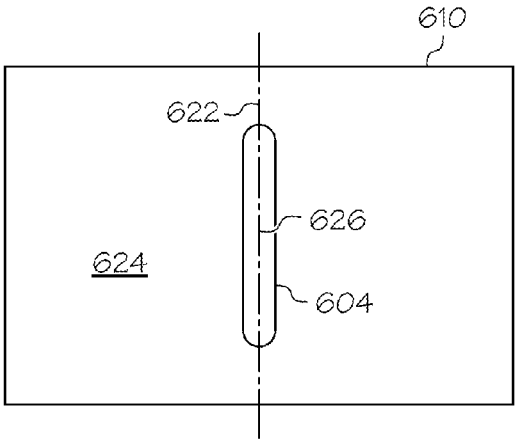
FIGS. 6B-6D are each top views of an example of a different type of plate or laminate that may be used to form the variable magnetic flux core of the electromagnetic device of FIG. 6A.
Figure 6C:
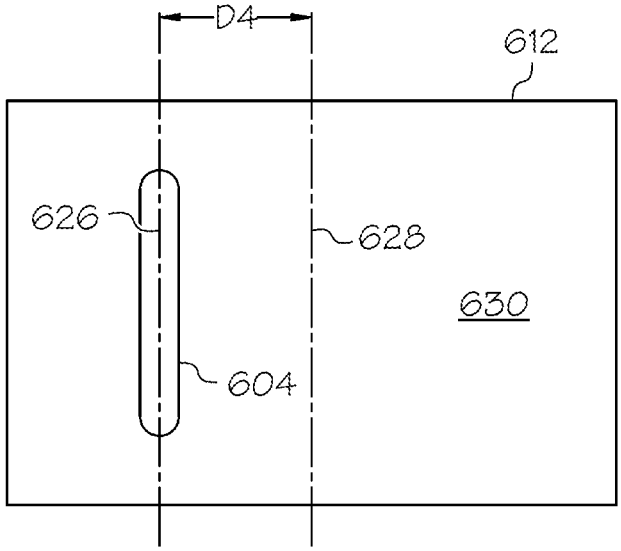
Figure 6D:
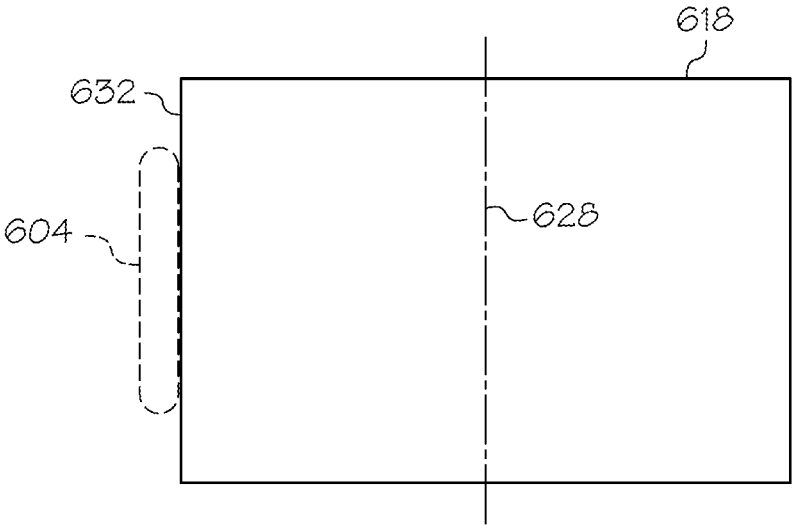

Each of the plurality of core sections 606*a*-606*j* may include one or more core plates 610-620 stacked on one another. The core plates 610-620 may be substantially similar to the core plates 510-516 in FIGS. 5B-5G except with only a single elongated opening 604. Each core plate 610-620 of a particular core section 606*a*-606*j* may include a substantially identical geometry. FIGS. 6B-6D are top views of examples of different core plates that may be used for core plates 610-620 in FIG. 6A.

FIG. 6B is an example of a first core plate 610 that may be stacked with one or more other first core plates 610 to form a first core section. Examples of first core sections may be core sections 606*a*, 606*c*, 606*e*, 606*h* and 606*j* in FIG. 6A. The substantially identical geometry of the first core plate 610 of the first core section 606*a* or similar core sections may include a first volume. A centerline 622 of a surface 624 of the first core plate 610 may be aligned with a centerline 626 of the elongated slot 604 when the first core plates are stacked to form the variable magnetic flux core.

Core plates 614 in FIG. 6A may have a similar geometry to core plates 610 but the core plates 614 are longer in at least one dimension as shown in the example of FIG. 6A and will therefore have a larger core volume and better capacity to absorb a stronger magnetic field. Therefore, the core plates 614 will have an increased inductance profile and performance than the core plates 610 with the smaller core volume.

Core plates 620 in FIG. 6A may also have a similar geometry to core plates 610 but the core plates 620 are shorter in at least one dimension and therefore will have a smaller core volume. The core plates 620 will then also have a lesser capacity to absorb magnetic fields than the larger volume core plates 610 and the core plates 610 will have a better inductance profile and performance compared to the core plates 620 with the smaller core volume.

FIG. 6C is an example of a second core plate 612 that may be stacked with other second core plates 612 to form a second core section. The core section 606*b* in FIG. 6A is an example of a second core section. The substantially identical geometry of the second core plate 612 of the second core section may include a second volume. A centerline 628 of a surface 630 of the second core plate 612 may be a predetermined distance "D4" from the centerline 626 of the elongated slot 604.

FIG. 6D is an example of a third core plate 618 that may be stacked with other third core plates 618 to form a third core section. The core section 606*f* in FIG. 6A is an example of a third core section. The substantially identical geometry of the third core plate 618 of a third core section may include a third volume and the elongated slot 604 through the stacked plurality of core sections 606*a*-606*j* of the variable magnetic flux core 602 may extend adjacent one side 632 of the third core section 618 as illustrated by the elongated slot 604 being shown in phantom in FIG. 6D.

Core plates 619 may be similar to third core plates 618 but the core plates 619 have a smaller length is one dimension as shown in FIG. 6A and therefore will have a smaller core volume for absorbing a magnetic field than the third core plates 618 with a larger volume. The third core plates 618 will also have an increased inductance profile and performance capacity compared to the smaller core plates 619.

In accordance with an embodiment, of the electromagnetic device 600, the first volume, the second volume and the third volume of the core plates 610-618 may be equal. In another embodiment the volumes may be predetermined to provide a predetermined inductance performance and profile.

The plurality of core sections 606*a*-606*j* may also include at least two differing materials and provide at least two different inductance performance profiles.

Figure 7:
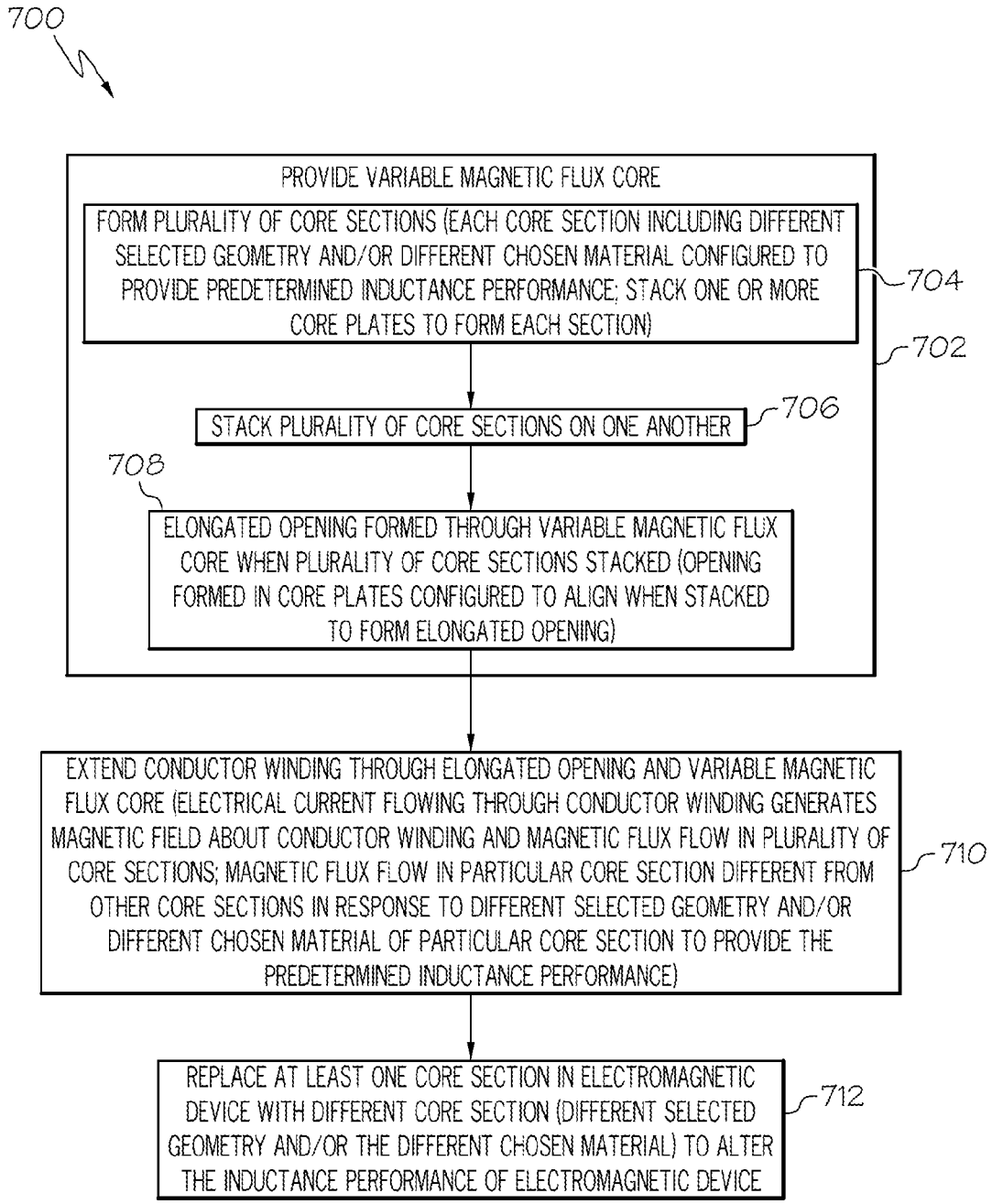
FIG. 7 is a flow chart of an example of a method for providing a predetermined inductance performance by an electromagnetic device in accordance with an embodiment of the present disclosure.

FIG. 7 is a flow chart of an example of a method 700 for providing a predetermined inductance performance by an electromagnetic device in accordance with an embodiment of the present disclosure. In block 702, a variable magnetic flux core may be provided. In block 704, which may be part of providing the variable magnetic flux core, a plurality of core sections may be formed. Each core section may include at least one of a different selected geometry and a different chosen material configured to provide a predetermined inductance performance or profile by the core section. Each core section may be formed by stacking one or more core plates on one another. Each core plate of a particular core section may have at least one of a substantially identical geometry and made from a chosen material to provide the predetermined inductance performance when stacked to form the particular core section.

In block 706, a plurality of core sections may be stacked on one another to form the variable magnetic flux core.

In block 708, depending upon the geometry of a particular core section, each of the core plates of the core section may have an opening formed therein such that the opening through each core plate will be aligned when the core plates are stacked on one another to form an opening through the particular core section. The openings through each of the core sections are configured to be aligned with one another when the core sections are stacked on one another to form the opening through the variable magnetic flux core similar to that previously described and shown in FIGS. 5A and 6A. The opening through the variable magnetic flux core may be an elongated opening configured for receiving at least one conductor winding extending through the opening and the variable magnetic flux core similar to that previously described herein. Accordingly, a first core section of a plurality of core sections of a variable magnetic flux core may be formed by stacking one or more first core plates each having a substantially identical geometry configured to provide a first volume when the one or more first core plates are stacked. A centerline of a surface of the first core plates may be aligned with a centerline of the elongated opening such that the elongated opening is formed through the center of the first core section when the one or more first core plates are stacked.

A second core section of the plurality of core sections of the variable magnetic flux core may be formed by stacking one or more second core plates each having a second substantially identical geometry configured to provide a second volume when the one or more second core plates are stacked. A centerline of a surface of the second core plate may be a predetermined distance from the centerline of the elongated slot when the one or more second core plates are stacked to provide a second core section. Accordingly, the elongated slot will be offset from a centerline of any second core sections.

A third core section of the plurality of core sections of a variable flux core may be formed by stacking one or more third core plates each having a third identical geometry configured to provide a third volume when the one or more third core plates are stacked. The geometry of the third core plates may be configured such that the elongated opening through the stacked plurality of core sections extends adjacent one side of the third core section.

In block 710, a conductor winding may be extended through the elongated opening and variable magnetic flux core. An electrical current flowing through the conductor winding generates a magnetic field about the conductor winding and a magnetic flux flow in the plurality of stacked core sections. The magnetic flux flow in a particular core section will be different from other core sections in response to or based on at least one of the different selected geometry and the different chosen material of the particular core section to provide the predetermined inductance performance or profile.

In block 712, at least one core section and the electromagnetic device may be replaced with another core section including at least one of a different selected geometry or a different chosen material to alter the inductance performance or profile of the electromagnetic device.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Although specific embodiments have been illustrated and described herein, those of ordinary skill in the art appreciate that any arrangement which is calculated to achieve the same purpose may be substituted for the specific embodiments shown and that the embodiments herein have other applications in other environments. This application is intended to cover any adaptations or variations of the present disclosure. The following claims are in no way intended to limit the scope of the disclosure to the specific embodiments described herein.

What is claimed is:

1. An electromagnetic device, comprising:

a variable magnetic flux core comprising a plurality of core sections stacked on one another, at least one core section of the plurality of core sections comprising a different selected geometry from other core sections, the at least one core section being configured to provide a predetermined inductance performance in response to the different selected geometry; and an opening through the stacked plurality of core sections of the variable magnetic flux core for receiving a conductor winding extending through the opening and the variable magnetic flux core, wherein an electrical current flowing through the conductor winding generates a magnetic field about the conductor winding and a magnetic flux flow in each of the plurality of core sections of the variable magnetic flux core, the magnetic flux flow in the at least one core section being different from the other core sections in response to the different selected geometry of the at least one core section to provide the predetermined inductance performance, wherein each of the plurality of core sections comprises a centerline and the opening through the at least one core section comprising the different selected geometry is offset a particular distance from the centerline of the at least one core section that is different from at least one other core section of the plurality of core sections.

2. The electromagnetic device of claim 1, wherein the opening through the stacked plurality of core sections of the variable magnetic flux core comprises an elongated slot.

3. The electromagnetic device of claim 2, wherein each of the plurality of core sections comprises one or more plates stacked on one another, each plate of a particular core section including a substantially identical geometry.

4. The electromagnetic device of claim 3, wherein the substantially identical geometry of a first core plate of a first core section comprises a first volume and a centerline of a surface of the first core plate is aligned with a centerline of the elongated slot.

5. The electromagnetic device of claim 4, wherein the substantially identical geometry of a second core plate of a second core section comprises a second volume and a centerline of a surface of the second core plate is a predetermined distance from the centerline of the elongated slot.

6. The electromagnetic device of claim 5, wherein the substantially identical geometry of a third core plate of a third core section comprises a third volume and the elongated slot through the stacked plurality of core sections of the variable magnetic flux core extends adjacent one side of the third core section.

7. The electromagnetic device of claim 6, wherein the first volume, the second volume and the third volume are equal.

8. The electromagnetic device of claim 1, wherein the plurality of core sections comprise at least two differing materials and provide at least two different inductance performance profiles.

* * * * *